252-99 AU 166 EX
12/30/80 XR 4,242,215

United States Patent [19]
Smid et al.
[11] 4,242,215
[45] Dec. 30, 1980

[54] SUBSTANTIALLY ENVIRONMENTAL-POLLUTION-FREE LAUNDRY DETERGENT COMPOSITION

[75] Inventors: Jacob K. Smid; Johan G. Aalbers, both of Bodegraven, Netherlands

[73] Assignee: Chem-y, Fabriek Van Chemische Produkten B.V., Bodegraven, Netherlands

[21] Appl. No.: 956,424

[22] Filed: Oct. 31, 1978

Related U.S. Application Data

[63] Continuation of Ser. No. 368,361, Jun. 8, 1973, abandoned.

[30] Foreign Application Priority Data

Jun. 13, 1972 [GB] United Kingdom ..... 27618/72

[51] Int. Cl.[3] ..... C11D 3/60
[52] U.S. Cl. ..... 252/100; 252/99; 252/136; 252/142
[58] Field of Search ..... 252/99, 100, 136, 142, 252/531, 89 R

[56] References Cited

U.S. PATENT DOCUMENTS

| | | | |
|---|---|---|---|
| 2,183,853 | 12/1939 | Haussmann et al. | 260/404 |
| 2,993,745 | 7/1961 | Dorsett | 8/108 |
| 3,600,318 | 8/1971 | Mast | 252/99 |
| 3,630,930 | 12/1971 | Davis et al. | 252/531 |
| 3,658,727 | 4/1972 | Mast | 252/538 |
| 3,741,911 | 6/1973 | Shane | 252/527 |
| 3,819,538 | 6/1974 | Little et al. | 252/527 |
| 3,956,198 | 5/1976 | Bauer | 252/546 X |
| 4,104,023 | 8/1978 | Woo et al. | 252/558 X |

FOREIGN PATENT DOCUMENTS

| | | | |
|---|---|---|---|
| 811732 | 4/1959 | United Kingdom . | |
| 833568 | 4/1960 | United Kingdom . | |
| 1169496 | 11/1969 | United Kingdom | 252/110 |
| 1292352 | 10/1972 | United Kingdom . | |

OTHER PUBLICATIONS

Matzner et al., "Organic Builder Salts as Replacements for Sodium Tripolyphosphate (II)", *Tensides Detergents*, 10 (5), 239–245, (1973).

*Primary Examiner*—Harris A. Pitlick
*Attorney, Agent, or Firm*—Browdy and Neimark

[57] ABSTRACT

A detergent composition is provided containing as essential ingredients one or more surfactants, one or more builders, perborate, and a member of the group chosen from (a) acidic substances acceptable in detergent compositions and having a pK value of at least 2, and (b) compounds which in aqueous solutions of said compositions form said substance in situ, a 0.5% aqueous solution of said composition having an initial pH of 5.0–8.5, measured at room temperature.

The composition may contain further usual additives, and is preferably substantially phosphate-free. Surfactants of the polyether-carboxylic acid type may be used herein advantageously.

9 Claims, No Drawings

SUBSTANTIALLY ENVIRONMENTAL-POLLUTION-FREE LAUNDRY DETERGENT COMPOSITION

This is a continuation of application Ser. No. 368,361 filed June 8, 1973, now abandoned.

This invention relates to novel, phosphate-free detergent compositions which are especially suitable for household and commercial laundering purposes.

Environmental pollution constitutes ever-increasing problem, and, in particular, it has been established in recent years that the phosphates and polyphosphates are a very serious source of water pollution. An important part of the pollution phosphates reaches the water through household and industrial waste liquids wherein they are present as residues of detergent compositions. The problem is further aggravated by the fact that household detergents are nearly always used in far greater amounts than would be strictly necessary, a custom which appears ineradicable.

Accordingly, there is a great need for detergent compositions which are free or at least substantially free of phosphates, and still satisfy the high standards to which the public has become accustomed. Several approaches to this problem have been tried already, but a universal solution has not been found.

Phosphates in detergent compositions are usually present for several purposes, for instance, as builder component and as sequestering agents.

Normally, built detergent compositions are so formulated that they are relatively strongly alkaline, i.e. they have a pH of about 10.5 or more in aqueous solutions. Before the ready-to-use washing powders became available, soap and soda were used in the household, and this combination may perhaps be considered the first built detergent. The washing powders on soap basis which then became available necessarily had also to be strongly alkaline, and this tradition was continued with the built detergent compositions, partially or entirely based on synthetic anionic or nonionic detergents. There are, of course, some detergent compositions, which on dissolving in water in the normal use concentration, only yield a slightly alkaline pH (about 7.5), for example the commercial product "Dreft", but such products are only recommended for fine laundering (wool and the like) at temperatures of no more than 60° C. Similar compositions have been proposed in Dutch Pat. applications Nos. 7006465 and 7006466. These compositions contain (a) a synthetic surfactant chosen from classes of compounds among which the most usual alkylbenzene sulfonates fail, (b) a proteolytic enzyme, and (c) 10–75% of either a polycarboxylic acid having a sequestering activity (application No. 7006465) or a sequestering agent of the usual phosphate type. (application No. 7006466).

These compositions have as 0.12% aqueous solutions pH values of 6–8.5 and the advantages of washing at such low pH values have been discussed, but the compositions of these applications are not general purpose detergents, and they either do not solve the phosphate problem, or only do so by using much more expensive sequestrants. General purpose detergent compositions up until now always have been at least fairly strongly alkaline. The necessity to launder with synthetic detergents in alkaline medium and especially in the presence of phosphates has also been discussed by Kurt Lindner in "Tenside-Textilhilfsmittel-Waschrohstoffe", Band III, Stuttgart, 1971, pages 2268–2270. Furthermore, Stupel in his book "Synthetische Wasch- und Reinigungsmittel", 1954, shows in FIG. 61 on page 177 that the synthetic detergents of the alkyl sulfate type show optimum washing capacities at pH's of about 8–9, whilst at pH 10 still fairly good values are obtained.

The classical problem in all washing and laundering processes is the water hardness. As is well known, the calcium (and other polyvalent metal) compounds present in hard water give rise to the forming of insoluble compounds. In the case of the main source of trouble, calcium, two kinds of insoluble compounds can be formed, (a) the calcium soaps or calcium salts of the anionic synthetic detergents and (b) inorganic calcium salts primarily calcium carbonate.

The carbonates and other inorganic calcium salts precipitate at the pH-values and temperatures which are customary in the washing or laundering solutions prepared with the generally used builders-containing detergent compositions. It is for that reason that sequestering agents have to be incorporated in the laundering compositions. Instead of polyphosphates, other sequestering agents, such as nitrilotriacetic acid (NTA) or ethylenediaminetetra-acetic acid (EDTA) can be used, but these compounds are either more expensive or less efficient, or both, and in recent publications it has already been doubted whether NTA is sufficiently safe from a health standpoint.

Surprisingly, it has now been found that detergent compositions which contain one or more builders, perborate, and, if desired, further usual additives and which are entirely or largely phosphate-free can be prepared, by neutralizing the compositions with an acid acceptable in detergent compositions and having a pK value of at least 2 to such an extent that a 0.5 percent aqueous laundering solution obtained therewith has an initial pH of 5.0–8.5 preferably 6.5–8.0 and most preferably 7.5–8.0 measured at room temperature. The required acid may be formed in situ by adding a stronger acid to a composition containing a salt of a weak acid.

It should be remarked here that the invention provides the possibility of preparing completely phosphate-free detergent compositions which not only show a satisfactory performance, but in some cases are even better than presently available commercial detergent compositions which contain a considerable phosphate content. However, if desired, a small amount of phosphate, e.g. up to 5%, based on the weight of the dry substances, may be incorporated in the compositions for attaining special effects. However, in view of the pollution problem, completely phosphate-free compositions are preferred.

Although the invention is not limited by theoretical considerations and although the exact mechanisms which lead to the unexpected results of the invention are not completely understood, it is presumed that these results may be connected with the buffering action caused by the combination of the added acid and the other components of the composition, particularly the perborate. A neutralization according to the invention with acids having a pK value of at least 2 leads to some—but not a complete—buffering action, i.e. during the laundering process the pH will never reach the high values normally encountered with the known general purpose detergents.

A number of experiments were carried out with water of 30° German hardness. In the first place experiments were carried out with detergents of the class of the formula $RO\text{-}(C_2H_4O)_n(CH_2)_xCOOM$, wherein R is an aliphatic hydrocarbon residue of 8–20 carbon atoms or an aliphatic-aromatic residue having 4–20 carbon atoms in the alkyl moiety, n is a number having an average value of 1–10, x is one of the integers 1 and 2, and M is a cation. This is a preferred class of detergents to be used according to the invention, because the calcium salts of these compounds are water-soluble. Moreover, these detergents have a low toxicity, and anti-corrosion properties. They are well-known compounds, and in French Pat. specification No. 2042793 it has been proposed to use such detergents in laundering compositions together with soap. The compositions of this French patent specification are alkaline, and although they can be prepared without phosphate, this is at the expense of the performance.

A number of these compounds were formulated to powdery laundering compositions with sodium sulfate as builder, sodium perborate as bleaching agent, and with further common additives, i.e. magnesium silicate, sodium carboxy-methyl cellulose, a small amount of sodium silicate (this is an anti-corrosion agent, which was included in order to obtain a fair comparison with other detergents), and optical brightener. These compositions yielded ready-for-use solutions having a pH of about 10 at room temperature in a concentration of 0.5%. A second series of compositions was prepared in an identical way, but this time citric acid was added in such an amount that on dissolution in water the compositions yielded 0.5% aqueous solutions having a pH of 7 at room temperature. It should be emphasized here that both series were completely phosphate-free. Comparative laundering experiments were carried out in a Tergotometer with standard soiled cotton swatches sold by U.S. Testing Company. In these experiments the reflectance values after repeated washings were determined as measure of the detergent effect. Both series of compositions washed well, but the neutralized compositions yielded much less "incrustration" (calcium precipitates) as will be explained hereinafter.

At this point of the investigation the possibility was considered that the citric acid might also function as a complexing agent, and, accordingly, the above experiments were repeated using sodium bisulfate as neutralizing and buffering agent instead of the citric acid. The same results were obtained so that it is clear that these are not due to a complexing effect.

Comparative experiments were carried out with the composition which will be more fully described hereinafter in Example 1, with the same composition without neutralizing agent, and with two commercial products "Persil 70", and "OMO". The neutralized product clearly washed somewhat better than the other three products which showed substantially the same effects. Of course, the commercial products contained phosphates. Further experiments were then carried out with compositions containing alkyl benzene sulfonate as anionic detergent. These experiments were carried out with the composition of Example 2 (hereinbelow) and with an identical composition which, however, had not been neutralized. Again these detergent compositions did not show any appreciable difference in their cleaning effect which was about the same as of the commercial products, the neutralized commercial products, and the composition of Example 1 without neutralizing agent. Furthermore, the same experiments were carried out with two alkyl sulfates cetyl and lauryl sulfate. Cetyl sulfate was a better laundering detergent than lauryl sulfate in the present experiments. The sulfates were again formulated to phosphate-free compositions, (vide Example 3 for the compositions with cetyl sulfate), and they were used both in neutralized and unneutralized state. No appreciable differences could be noticed between the alkaline and the neutral compositions with cetyl sulfate, which showed about the same washing effects as the commercial products, etc. The compositions with lauryl sulfate were clearly somewhat inferior, but again there was no appreciable difference in action between the alkaline and the neutral compositions.

The buffered phosphate-free compositions show an excellent laundering action, which is at least as good as that of the known phosphate-containing alkaline compositions. The principal difference between the abovementioned detergents after formula $RO\text{-}(C_2H_4O)_n(CH_2)_xCOOM$ and the other more usual detergents is that the calcium salts of the firstmentioned detergents are water-soluble so that no "incrustration" with calcium salts occur at all. This appears from the ash contents of repeatedly laundered standard swatches, the ash content being acceptable in all cases, but being at least as good as or even better than of the commercial products of considerable phosphate content in the case of the compositions containing the abovementioned preferred detergents. Moreover, these detergents have outstanding anti-corrosive properties.

The above results were confirmed by tests, wherein a buffered laundering powder of the invention containing the detergent of Example 1 was given to a number of housewives who tried the composition without knowing its formulation, and afterwards wrote down their experiences. Some of them lived in a town where the tap water had 30° German hardness and some others lived in a town where the tap water had 15° German hardness. In this way the composition was tested in various household laundering machines and compared with various commercial products, all of which are high in phosphate content. The unanimous results were that the novel product cleaned the laundry as well as or better than the commercial products to which the ladies were accustomed and that metal parts, especially the heating coils, stayed completely clean, and in some cases became cleaner during the experiment with the novel composition.

In the above detergent compounds of the polyether-carboxylic acid type the hydrocarbon residue R can be saturated or unsaturated, and it may contain an aromatic nucleus. Of course, the number of carbon atoms of this residue has some influence on the HLB-value of the product. Preferably, the residue R contains 12–14 carbon atoms in which case average values of n in the range of 3–5 yield highly satisfactory products.

As is well known, those compounds, wherein x is 1, can be prepared by either reacting a polyether alcoholate of the formula $RO\text{-}(C_2H_4O)_nMe$, wherein Me is an alkali metal, with a haloacetic acid or salt thereof, or oxidizing a compound of the formula $RO\text{-}(C_2H_4O)_{n+1}H$, whilst compounds, wherein x is 2, can be prepared by reacting a compound $RO\text{-}(C_2H_4O)_nH$ with e.g. acrylonitrile, followed by hydrolysis. The abovementioned ethoxylated intermediates are in turn prepared by ethoxylating a compound of the formula ROH.

A particularly suitable starting product of the formula ROH is commercial lauryl alcohol derived from oils and fats which contains about 70–75% of n-lauryl alcohol and about 25–30% of other alcohols having even numbers of carbon atoms, mainly tetradecyl alcohol. From this commercial alcohol a very satisfactory detergent product can be prepared. Of course, synthetic alcohol products, also the branched products (such as the oxo alcohols) and the like can be used likewise.

As is well known, a mixture of products having various values of n is formed during the ethoxylation reaction, and accordingly, the final product will also be a mixture having various values of n. Sometimes it may be preferred to use a product which is a mixture which shows a rather narrow distribution of n values. As disclosed in British Pat. specification No. 1,027,481, salts of the formula $RO\text{-}(C_2H_4O)_nCH_2COOM$ (wherein M is a cation) having a narrow distribution of n values can be prepared by starting from an ethoxylation product $RO\text{-}(C_2H_4O)_nH$ having already such a narrow distribution. The ethoxylation product having the desired narrow distribution of n values can be obtained in turn by separating a desired fraction from a broader range of ethoxylation products, but it is also possible to carry out the ethoxylation with acidic catalysts, such as described for example in U.S. Pat. No. 2,870,220.

Instead of or in combination with the above class of anionic detergent compounds, other anionic detergents can also be used. As important other classes can be mentioned for example alkylbenzene sulfonates and alkyl sulfates. Soaps can also be used, either alone or in combination with other detergents, but of course in the case of soaps the composition should not be neutralized to a pH lower than about 7. Besides the anionic detergents, the composition can also contain nonionic ampholytic and/or zwitterionic surfactant compounds, as is often usual, whilst for special purposes also small amounts of cationic surfactants may be present, especially in the case of the preferred detergent class. Also the detergent compositions of this invention can contain surfactants which entirely or predominantly are nonionic in nature. Numerous surfactants are commercially available and have been fully described in literature, for instance in "Surface Active Agents and Detergents", volumes I and II, by Schwartz, Perry and Berch.

Usual builders can be utilized in the compositions of this invention, but, of course, two things should be kept in mind: (a) phosphates should not be used at all, or at most in very small amounts, and (b) the more strongly alkaline builders are used, the more acid will be needed for the neutralization. Accordingly, sodium sulfate which is a substantially neutral compound and a good builder is a very practical compound for use in the present compositions, and preferably this compound constitutes the major part or even the entirety of the builder. General purpose laundering compositions contain bleaching agents of the perborate type. In the present compositions the perborate has the double function of bleaching agent and of constituent of the buffer system, since the relatively strongly basic perborate forms part of the alkaline constituent of the buffer system. In recent years, the German firm Henkel has invented various activators for perborate, vide the printed German applications Nos. (Offenlegungsschriften) 1,594,865; 1,961,755 and 2,061,862. Such activators can be added to the present compositions, in order to improve the bleaching action at the relatively low pH values of the laundering operation. An example of such an activator is tetra-acetylglycoluril.

Of course, further usual additives can also be used in the present compositions, for instance optical brighteners, odoring agents, colorants, cellulose derivatives, such as sodium carboxymethylcellulose, magnesium silicate, enzymes, antifoam agents, and so on.

In principle, any acidic substance which either has a pK value of at least 2 or forms such an acid in situ could be used for neutralizing the compositions according to the invention. However, it is a matter of course that the acidic substance should be acceptable in the composition in the amount necessary to obtain the desired neutralization. Particularly suitable are substances like citric acid, sodium or potassium bisulfate, tartaric acid and the like. Phosporic acids would be suitable, but of course they are preferably not used, in order not to frustrate the aim of this invention.

The compositions of this invention are preferably prepared in solid form.

A general purpose detergent composition will contain in dry form e.g. about 10–25% by weight of detergent surfactants, about 15–35% by weight of perborate, about 0.5–2% of sodium carboxymethylcellulose, about 30–70% by weight of builder (predominantly or entirely sodium sulfate), if desired up to 5% by weight of magnesium silicate, if desired up to 6% weight of sodium silicate, if desired 0.1–0.3% by weight of optical brightener, and an acceptable acidic agent having a pK value of at least 2 in the amount necessary to achieve the desired neutralization.

It is important to note that the various experiments were carried out in water of 30° German hardness. This is very hard water which—fortunately—only occurs in relatively restricted areas. The excellent low incrustrations obtained with the present compositions in such hard water show that in water of a more average degree of hardness (about 15°) the compositions will still prevent incrustration, even in a dosage which normally should be considered too low. In this respect it should be remarked that such too low dosages are always bound to occur at the moment the first rinsing treatment is started during laundering either manually or in a machine. It is extremely important that even at this crucial moment virtually no risk for incrustration exists with the present compositions.

Another important advantage of the present compositions is that they cause very little damage to the fabrics, even after numerous laundering treatments. This is probably due to both the approximate neutral pH of the laundering operation, and the substantial absence of incrustration. Also laundering machines show less corrosion, when the present compositions are used.

The present compositions can be used at about 90° C., the normal washing temperature for cotton and the like, but they also perform excellently at lower temperatures which are usual for more tender fabrics, such as rayon and polyester. Thus, experiments on mixed rayon-polyester fabrics at 60° C. yielded excellent results.

The following examples illustrate the invention, without, however, limiting it in any way.

EXAMPLE I

A phosphate-free general purpose detergent composition was prepared by thoroughly mixing the following ingredients in the amounts mentioned hereinafter.

| ingredients | parts by weight |
|---|---|
| RO—$(C_2H_4O)_{4.5}CH_2COOH$ wherein R is derived from a commercial alcohol mixture containing about 70% $C_{12}$ and 30% $C_{14}$ alcohol | 18 |
| Sodium carboxymethylcellulose | 1 |
| sodium perborate | 20 |
| magnesium silicate | 3 |
| sodium sulfate | 50 |
| citric acid | 8 |
| optical brightener | 0.2 |

EXAMPLE II

A detergent composition was prepared from the following ingredients, used in the following amounts:

| ingredients | parts by weight |
|---|---|
| dodecyl benzene sulfonic acid | 18 |
| sodium carboxymethylcellulose | 1 |
| sodium perborate | 20 |
| magnesium silicate | 3 |
| sodium sulfate | 50.8 |
| citric acid | 7 |
| optical brightener | 0.2 |

EXAMPLE III

A detergent composition was prepared, containing the following ingredients in the following amounts:

| ingredients | parts by weight |
|---|---|
| sodium hexadecyl sulfate | 18 |
| sodium carboxymethylcellulose | 1 |
| sodium perborate | 20 |
| magnesium silicate | 3 |
| sodium sulfate | 45 |
| citric acid | 13 |
| optical brightener | 0.2 |

EXAMPLE IV

A detergent composition was prepared containing the following ingredients in the following amounts:

| ingredients | parts by weight |
|---|---|
| RO—$(C_2H_4O)_6CH_2COOH$, wherein R is derived from myristyl alcohol | 18 |
| sodium carboxymethylcellulose | 1 |
| sodium perborate | 20 |
| magnesium silicate | 2 |
| sodium sulfate | 47 |
| potassium bisulfate | 12 |
| optical brightener | 0.2 |

EXAMPLE V

A detergent composition was prepared containing the following ingredients in the following amounts:

| ingredients | parts by weight |
|---|---|
| RO—$(C_2H_4O)_8H$, wherein R is derived from a synthetic alcohol mixture containing about 55% $C_{12}$ and 45% $C_{13}$ alcohol and having a branched alcohol content of about 25% | 18 |
| sodium carboxymethylcellulose | 1 |
| sodium perborate | 20 |
| magnesium silicate | 2 |
| sodium sulfate | 49 |

-continued

| ingredients | parts by weight |
|---|---|
| citric acid | 10 |

The recommended amount to be used of the dry composition of the above examples is always about 5 grams per liter.

EXAMPLE VI

The following detergent composition was prepared:

| ingredients | parts by weight |
|---|---|
| RO—$(C_2H_4O)_{3.8}CH_2COONa$ wherein R is derived from the same alcohol mixture as in Example I, and the values of "n" show a narrow distribution | 16.5 |
| magnesium silicate | 2.0 |
| sodium silicate | 1.3 |
| sodium carbonate | 3.3 |
| sodium sulfate | 27.9 |
| ethylenediaminetetraacetic acid | 0.6 |
| sodium perborate | 28.9 |
| sodium carboxymethyl cellulose | 1.0 |
| optical brightener | 0.2 |
| citric acid | 18.3 |

Teg-O-Meter experiments were carried out with 5 g/l of this composition and with the same dose of Persil 70, using the abovementioned standard soiled cotton swatches sold by U.S. Testing Company. After a number of washing cycles the incrustration on the swatches was measured as increase of ash content in mg per gram of fabric. In the experiments with Persil 70 an incrustration of 10 mg/g was found after 5 washing cycles and of 25 mg/g after 10 washing cycles. With the product of the invention the incrustration was only 2 mg/g, both after 5 and after 10 washing cycles.

EXAMPLE VII

The following detergent composition was prepared:

| ingredients | parts by weight |
|---|---|
| RO—$(C_2H_4O)_{3.8}CH_xCOONa$ (same product as in Example I) | 1.7 |
| dodecylbenzenesulfonic acid, sodium salt | 15.2 |
| nonylphenyl-$(OC_2H_4)_{9.5}$—0H | 1.3 |
| sodium carboxymethyl cellulose | 1.0 |
| sodium silicate | 3.0 |
| magnesium silicate | 2.0 |
| optical brightener | 0.1 |
| sodium perborate | 25.0 |
| sodium bisulfate | 29.7 |
| water | 5.0 |

A 1% aqueous solution of this composition had a pH of 7.3.

EXAMPLE VIII

The following detergent composition was prepared:

| ingredients | parts by weight |
|---|---|
| RO—$(C_2H_4O)_{3.8}CH_2COONa$ (same product as in Example VI) | 8.0 |
| dodecylbenzenesulfonic acid, sodium salt | 5.4 |
| (lauryl-myristyl)-$(OC_2H_4)_{13}OH$ | 5.4 |
| sodium carboxymethyl cellulose | 1.0 |
| sodium silicate | 3.0 |
| magnesium silicate | 2.0 |

-continued

| ingredients | parts by weight |
|---|---|
| optical brightener | 0.1 |
| sodium perborate | 25.0 |
| sodium bisulfate | 17.5 |
| sodium sulfate | 27.6 |
| water | 5.0 |

A 1% aqueous solution of this composition has a pH of 7.6.

The invention has been described herein with reference to certain embodiments as obvious variations therein will become apparent to those skilled in the art the invention is not to be considered as limited thereto.

What we claim is:

1. A substantially environmental-pollution-free detergent composition consisting essentially of about 10–15% by weight of at least one surfactant, about 30–70% by weight of at least one builder, about 15 to 35% by weight of perborate, about 0.5 to 2% by weight of cellulose derivative, and a member selected from the group consisting of (a) acidic substances acceptable in detergent compositions and having a pK value of at least 2, and (b) compounds which in aqueous solutions of said compositions form said substance in situ, said member being present in a sufficient amount such that a 0.5% aqueous solution of said composition has an initial pH of 5.0–8.5, measured at room temperature, said detergent composition containing no more than 5% phosphate.

2. A detergent composition according to claim 1, wherein said surfactant is selected from the group consisting of anionic, non-ionic, zwitterionic, and ampholytic surfactants and suitable combinations thereof.

3. A detergent composition according to claim 1, wherein said surfactant contains compounds of the formula $RO\text{-}(C_2H_4O)_n\text{-}(CH_2)_xCOOM$, where R is chosen from the group consisting of aliphatic hydrocarbon residues of 8–20 carbon atoms and aliphatic-aromatic residues having 4–20 carbon atoms in the alkyl moiety, n is a number having an average value of 1–10, x is one of the integers 1 and 2, and M is a cation.

4. A detergent composition according to claim 1, wherein said acidic substance is citric acid.

5. A detergent composition according to claim 1, wherein said acidic substance is an alkali metal bisulfate.

6. A detergent composition according to claim 1, wherein said builder contains sodium sulfate, and said compound which in aqueous solution of said composition forms said acidic substance in situ is sulfuric acid.

7. A detergent composition according to claim 1, said composition having as 0.5% aqueous solution an initial pH pf 6.5–8.0.

8. A detergent composition in accordance with claim 1, said composition having as 0.5% aqueous solution an initial pH of 7.5–8.0.

9. A detergent composition according to claim 1, said composition being substantially phosphate-free.

* * * * *